United States Patent [19]

Reinhall et al.

[11] 4,235,665

[45] Nov. 25, 1980

[54] METHOD AND APPARATUS FOR PRODUCING FIBER PULP IN A STEAM PRESSURIZED GRINDING SYSTEM

[75] Inventors: Rolf Reinhall, Bellevue, Wash.; Inge Johansson; Åke Sandstron, both of Täby, Sweden; Anders Mukvist, Bellevue, Wash.; Lars Elander, Täby, Sweden

[73] Assignee: American Defibrator, Inc., Minneapolis, Minn.

[21] Appl. No.: 964,572

[22] Filed: Nov. 29, 1978

Related U.S. Application Data

[63] Continuation of Ser. No. 808,713, Jun. 21, 1977, abandoned.

[30] Foreign Application Priority Data

Jun. 30, 1976 [SE] Sweden ..... 7607484

[51] Int. Cl.[3] ..... D21B 1/14; B27L 11/08; B23C 23/14

[52] U.S. Cl. ..... 162/23; 162/24; 162/28; 162/46; 162/261; 241/28; 241/79.1; 241/161; 241/244

[58] Field of Search ..... 162/23, 24, 28, 46, 162/47, 261, 68; 241/18, 23, 38, 246, 247, 76, 68, 79, 81, 17, 244, 245, 79.1, 161

[56] References Cited

U.S. PATENT DOCUMENTS

| | | | |
|---|---|---|---|
| 3,661,328 | 5/1972 | Leask | 241/18 |
| 3,847,363 | 11/1974 | Reinhall | 241/38 |
| 4,012,279 | 3/1977 | Selander et al. | 162/23 |
| 4,136,831 | 1/1979 | Cederquist et al. | 241/18 |

FOREIGN PATENT DOCUMENTS

| | | | |
|---|---|---|---|
| 46-27762 | 8/1971 | Japan | 162/28 |

*Primary Examiner*—S. Leon Bashore
*Assistant Examiner*—Peter Chin
*Attorney, Agent, or Firm*—Eric Y. Munson

[57] ABSTRACT

Method and apparatus for producing pulp from moisture-containing lignocellulosic material, such as wood chips, which is ground in a grinding space defined between a pair of grinding discs which rotate relative to one another in an environment of pressurized steam generated during the grinding process, in a closed housing. The ground fiber or pulp discharged from the grinding housing is propelled by the accompanying steam into a cyclone, where the ground pulp is separated from the steam for further treatment, while the steam is recycled for further use in the pulping process. The pressure in the cyclone is so controlled that a pressure is maintained therein which is substantially equal to a pressure drop which is sufficient merely to maintain the propellant force of the steam to convey the ground pulp from the grinding housing to the cyclone while discharging the separated steam and recycling it for further use in the pulping process.

6 Claims, 1 Drawing Figure

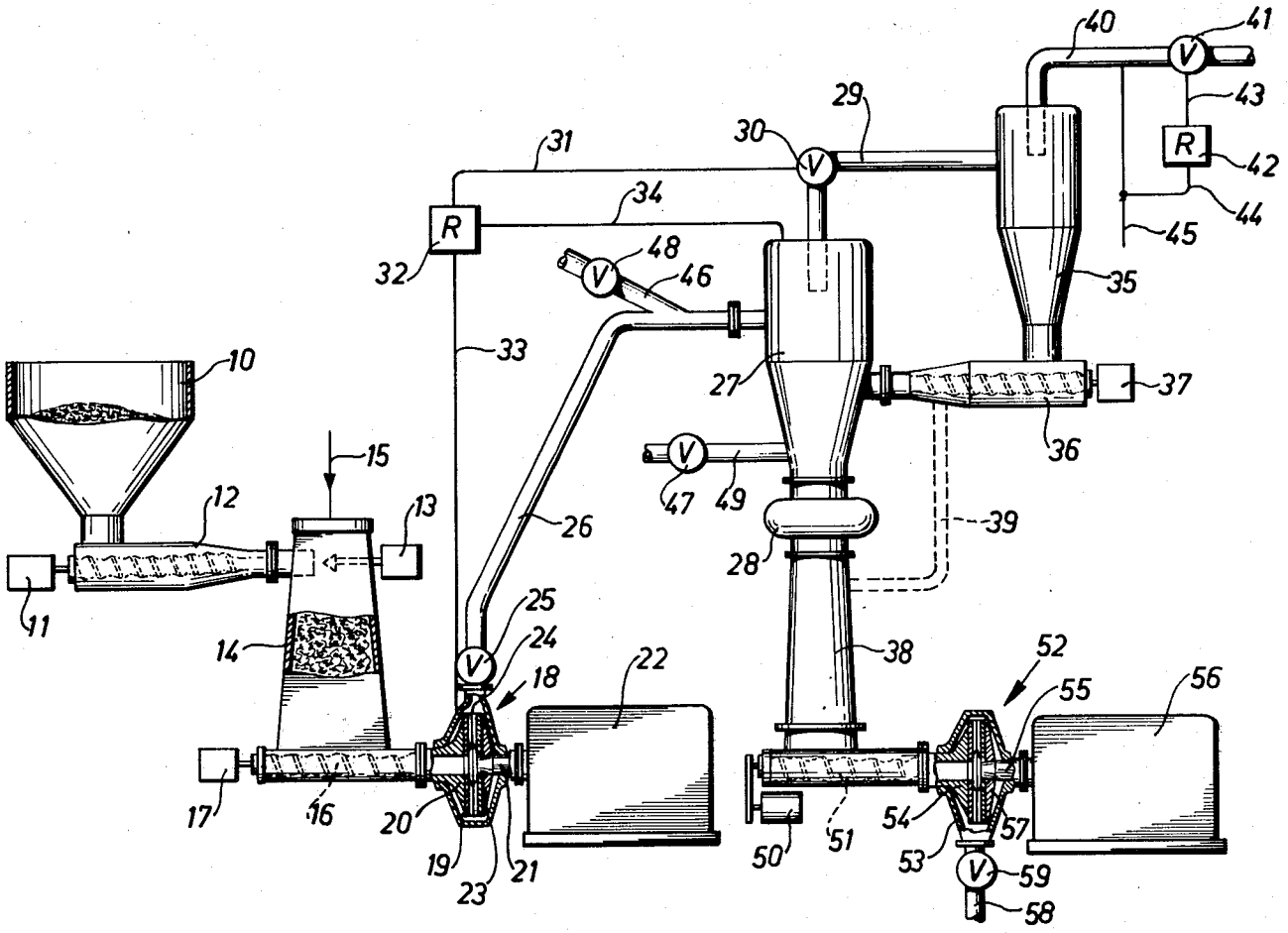
41
43
42
44
45
40
35
37
36
39
56
52
55
57
59
58
53
54
29
30
38
51
50
27
28
49
47
46
48
34
31
22
26
25
24
18
21
23
19
20
33
32
13
15
16
14
17
10
12
11

METHOD AND APPARATUS FOR PRODUCING FIBER PULP IN A STEAM PRESSURIZED GRINDING SYSTEM

This is a continuation, of application Ser. No. 808,713, Filed 6/21/77, now abandoned.

FIELD OF THE INVENTION

This invention relates to a method and a device producing fiber pulp in a steam-pressurized grinding apparatus.

More particularly this invention relates to a method and a device for producing fiber pulp by grinding of lignocellulose containing material in a steam-pressurized grinding apparatus, the ground pulp from the grinding apparatus being conveyed together with steam present therein through a pipe duct to a cyclone where fiber and accompanying steam are separated from one another and the ground fiber conveyed therefrom for further treatment.

BACKGROUND OF THE INVENTION

In the manufacture of refiner-mechanical or thermomechanical fiber pulps from lignocellulose containing material, the material treated in the grinding apparatus normally is supplied with so much of energy that moisture accompanying the material is rapidly vaporized due to temperature above 100° C. produced by friction. In order to prevent the material from being dried out during the grinding procedure with consequent exposure to excessive temperatures which are undesirable for the process, a quantity of water is added during the grinding operation to replace the amount of water evaporated from the material.

This results in the generation during the grinding procedure which steam must be removed from the grinding apparatus so as to avoid interference with the flow of material through the apparatus. In order to make full use of the heat content of the steam, the steam removal must be effected under the highest possible pressure without use of arrangements which might interfere with the pulping process.

MAIN OBJECTS OF THE INVENTION

Thus, one main object of the invention is to provide a method in connection with a steam-pressurized grinding apparatus from which the steam is removed at the highest possible pressure.

Another main object of the invention is to provide a method ensuring that the flow of material through the grinding apparatus and further pulp production process remain undisturbed despite withdrawal of the steam produced in the grinding apparatus under these high pressures.

Still another object of the invention is to provide an apparatus for carrying out the method of the invention in a simple and nevertheless reliable and easily controllable manner.

SUMMARY OF THE INVENTION

These and other objects of the invention are achieved by discharging the separated fibers in a vapor-proof manner from the receiver cyclone and so as to maintain in the cyclone a steam pressure substantially exceeding atmospheric pressure. In a preferred embodiment, there is maintained in the receiver cyclone a steam pressure which is only so much lower than the steam pressure maintained in the grinding apparatus so as to create a pressure drop merely sufficient to propel the fibers through the duct system. The steam separated off in the receiver cyclone can then at a corresponding high pressure be conducted either directly or through simple or series-connected cleaning means to other processes which require steam under superatmospheric pressure.

BRIEF DESCRIPTION OF THE DRAWING

The accompanying drawing is diagrammatic side view of a plant for carrying out the method of the invention and which forms part of this specification.

DETAILED DESCRIPTION OF A PREFERRED EMBODIMENT

Referring now to the drawing, reference numeral 10 denotes a storage bin for lignocellulose containing starting material, e.g. wood chips, which are fed by means of a screw feeder 12 driven by a motor 11 and provided with a plug former 13 into a steam-pressurized reaction vessel 14 in which the material is preheated. The steam is supplied from a source not shown through a pipe 15 to the vessel 14 for preheating the material. The bottom of the vessel 14 opens into a conduit in which a conveyor screw 16 for advancing the wood material is rotated by a motor 17 which conduit is connected to a grinding apparatus operated under steam pressure, such as a disc refiner 18, which comprises a closed casing 19 within which are disposed a stationary grinding disc 20 and a rotatable grinding disc 23 mounted on a shaft 21 in a frame 22. The starting material supplied by the conveyor screw 16 is passed through and during the passage defibrated in the grinding gap 24 between the discs 20, 23 rotating relatively to one another. The heat produced by friction during the disintegration of the material evaporates moisture accompanying said material and the steam generated thereby streams partially back through the screw 16 or separately arranged steam channels (not shown) into the reaction vessel 14 where the heat content of the steam is utilized for heating the material fed into the reaction vessel 14 to desired temperature. A portion of the steam generated in the grinding apparatus streams outwards together with the ground material through the grinding gap 24 between the grinding discs 20, 23 into the casing 19 enclosing said grinding discs.

The defibrated material collected in the grinding disc casing 19 is conveyed therefrom by the steam escaping from the gap 24 between the grinding discs through a blow valve 25 and a pipe duct 26 to a receiver or separating cyclone 27 for separating of fibers and steam from one another. The cyclone 27 is at its lower end in a vapor-tight manner connected to a discharge means 28 by which the fiber pulp separated off in the cyclone is discharged from the cyclone 27. The discharging means 28 used in this connection is of a type which permits discharge of the fiber pulp in a vapor-tight manner from the separating cyclone 27 and may, for example, the shape of a high density pump, a gear pump, a compressor screw feeder or a cell feeder or other similar conventional discharge means. By using a cell feeder as discharge means 28, it is possible to evacuate air in the cells by means of steam and thereby prevent such air from entering the cyclone 27.

A steam outlet pipe 29 extends from the top portion of the cyclone 27. Said pipe 29 is equipped with a valve 30 for controlling the steam pressure in the cyclone 27. The valve 30 serves to maintain a steam pressure in the cyclone 27 which substantially equal to the pressure drop required for propelling the material from the refiner 18 to the cyclone 27 and is thus only that much lower than the steam pressure maintained in the refiner 18. The valve 30 is controlled via a conductor wire 31 by a pressure differential governor 32 which in turn through conductor wires 33 and 34 is coupled to, respectively, the refiner 18 and the cyclone 27 and which continuously is actuated by the steam pressures prevailing in said refiner and cyclone, respectively. The steam from the outlet tube 29 may, for example, be supplied to an addtional steam cleaning cyclone 35 within which fibers accompanying the steam are separated off and through a screw feeder 36 which is driven by a motor 37, returned to the cyclone 27 or to an outlet tube 38 from the discharge means 28, as is indicated by dashed lines at 39. The surplus steam from the steam-cleaning cyclone is supplied via an outlet tube 40 with valve 41 and pressure governor 42 to some process or plant where the steam under excess pressure is utilized. The governor 42 controls the valve 41 via a conductor wire 43 and is actuated by the pressure in the tube 40 ahead of the valve 41 and by an external operation source via conductor wires 44, 45. Supplied to the fiber pulp before the feeding thereof into the cyclone 27 or within the same via pipes 46, 47 with valves 48, 49 is the quantity of dilution liquid required for the further working or treatment of the material with or without addition of chemicals.

The fiber pulp can be fed from the outlet pipe 38 of the high density pump 28 or the like member by a screw feeder 51 driven by a motor 50 into, for example, a directly connected second grinding apparatus such as a disc refiner 52. This second disc refiner 52 comprises, as does the first mentioned refiner 18, a closed casing 53 within which are housed a stationary grinding disc 54 and a rotatable grinding disc 57 mounted on a shaft 55 on a stand 56. From the second refiner the fiber pulp is discharged through an outlet tube 58 controlled by a valve 59 to additional process steps and further treatment.

It is obvious that the shown second refining of the fiber pulp in the refiner 52 can be replaced in some cases by some other treatment. In such a case, there is inserted behind the high density pump 28 or similar member a screw feeder (not shown) or other feeder device which conveys the fiber pulp further in the process. It is understood from the above description, that by the method and device of the invention, a steam removal is ensured at the highest possible pressure without interfering with the normal pulping process. The pressure difference between the first refiner 18 and the separating cyclone 27 is in this connection suitably adjusted so that it substantially only equal to the pressure drop necessary for propelling the fiber pulp through the duct 26 and to this extent is below the steam pressure maintained in the refiner 18. In this manner, a considerably improved heat economy in the process is obtained, since the separated steam under corresponding excess pressure can be conducted further to other processes which require or can make use of steam under this high pressure.

As already mentioned, the fiber pulp can be supplied after the separating cyclone 27 by the discharge means 28 to any arbitrary treating process depending on the intended further utilization of the pulp.

While one more or less specific embodiment of the invention has been shown and described, it is to be understood that this is for purpose of illustration only, and that the invention is not to be limited thereby, but its scope is to be defined by the appended claims.

What is claimed is:

1. The method for producing pulp from lignocellulose-containing fibrous material comprising:

(a) grinding the material in a steam pressurized defibrating apparatus (18);

(b) propelling the ground pulp material by the accompanying steam via a blow valve (24) through duct means (26) into a vapor-tight receiving cyclone (27);

(c) separating the pulp material from the accompanying steam in said receiver cyclone;

(d) discharging the separated pulp material from said receiver cyclone and passing it in a vapor-tight manner to a further pulp preparation station;

(e) discharging the separated steam and entrained fibers via valve means (30) to create a pressure drop in said receiving cyclone sufficient only to maintain the propellant force of the steam;

(f) passing the separated steam and entrained pulp fibers in a vapor-tight manner to a vapor-tight steam cleaning cyclone (35), where the entrained fibers are separated and recycled to the receiving cyclone; and (g) recycling the separated steam via valve means for further use in the pulp producing process.

2. The method according to claim 1, in which pulp treating agents are introduced into the receiving cyclone.

3. Apparatus for producing pulp from lignocellolose fibrous material comprising:

(a) a defibrator (18) in which the fibrous material is ground in an atmosphere of pressurized steam;

(b) a vapor-tight receiving cyclone (27) for separating pulp and steam discharged from said defibrator;

(c) a blow valve (25) controlling the discharge of ground pulp material and steam from said defibrator;

(d) vapor-tight duct means (26) through which the discharged pulp material is propelled by the accompanying steam into said receiving cyclone;

(e) secondary pulp preparation means (52);

(f) discharge means (28) for passing separated pulp material from said receiving cyclone in a vapor-tight manner to said secondary pulp preparation means;

(g) a vapor-tight steam cleaning cyclone (35) for secondary separation of steam and entrained fibrous material;

(h) valve-controlled means (29, 30) for discharging separated steam and entrained fibers from said receiving cyclone to said steam cleaning cyclone to create a pressure drop sufficient only to maintain the propellant force of the steam between said defibrator and the receiving cyclone;

(i) vapor-tight means for recycling the fiber material separated in said steam cleaning cyclone to said receiving cyclone; and (j) valve-controlled means for discharging surplus steam from said steam cleaning cyclone for further use in the pulp producing process.

4. Apparatus according to claim 3, in which said discharge means (28) for passing separated pulp material to said secondary pulp preparation means includes an outlet tube which directs the pulp material to feeding means for said secondary pulp preparation means.

5. Apparatus according to claim 3, in which the vapor-tight means for recycling the fiber material from the steam cleaning cyclone (35) to the receiving cyclone (27) includes feeding means connecting said steam cleaning cyclone with said receiving cyclone.

6. Apparatus according to claims 3, 4 or 5, further comprising means for introducing pulp-treating agents into said receiving cyclone.

* * * * *